US007959040B2

(12) United States Patent
Heirman

(10) Patent No.: US 7,959,040 B2
(45) Date of Patent: Jun. 14, 2011

(54) DISPENSING DEVICE FOR DISPENSING A PRODUCT

(75) Inventor: Björn Boris Igor Heirman, Haarlem (NL)

(73) Assignee: Rust-Oleum Netherlands B.V., RJ Roosendal (NL)

( * ) Notice: Subject to any disclaimer, the term of this patent is extended or adjusted under 35 U.S.C. 154(b) by 768 days.

(21) Appl. No.: 10/593,351

(22) PCT Filed: Mar. 18, 2004

(86) PCT No.: PCT/NL2004/000195

§ 371 (c)(1), (2), (4) Date: Feb. 7, 2008

(87) PCT Pub. No.: WO2005/087617

PCT Pub. Date: Sep. 22, 2005

(65) Prior Publication Data

US 2008/0190968 A1 Aug. 14, 2008

(51) Int. Cl.
*B65D 83/00* (2006.01)

(52) U.S. Cl. ..... 222/402.15; 222/383.1; 329/333

(58) Field of Classification Search ..... 222/402.15, 222/403.13, 207, 383.1, 153.13, 153.14, 222/383.2, 383.3, 384, 385; 239/333
See application file for complete search history.

(56) References Cited

U.S. PATENT DOCUMENTS

D237,777 S * 11/1975 Mc Donald ..... D9/542
3,987,842 A 10/1976 Chamdru
D244,991 S * 7/1977 Weckman et al. ..... D9/685
D248,832 S * 8/1978 Weckman ..... D9/543
4,278,187 A * 7/1981 Luedtke ..... 222/153.13
4,434,917 A 3/1984 Saito et al.
4,441,633 A * 4/1984 Bennett ..... 222/153.13
4,558,821 A 12/1985 Kawamoto et al.
4,705,191 A 11/1987 Barth et al.
5,156,304 A * 10/1992 Battegazzore ..... 222/341
D349,642 S * 8/1994 Abfier ..... D9/685
5,839,616 A 11/1998 Buisson et al.
5,992,708 A 11/1999 Gaichuk (Continued)

OTHER PUBLICATIONS

International Search Report Dated Jul. 12, 2004.

*Primary Examiner* — Lien T Ngo
(74) *Attorney, Agent, or Firm* — Abelman, Frayne & Schwab

(57) ABSTRACT

The invention relates to a dispensing device (1) for dispensing a product. The dispensing device comprises: a container (2) containing the product under pressure, the container having a top (7), bottom (5) and body portion (8), an axial direction being defined between the bottom and top; a valve mechanism (3) mounted at the top of the container, the valve mechanism being movable with respect to the container for pressurized discharge of the product out of the container; and a dispensing cap (4) mounted on the top of the container. The dispensing cap carries: a nozzle (21) debouching outside the cap for spraying the product, the nozzle being connected to the valve mechanism by a conduit; and art actuating member (23) having a horizontal arm (25) and a vertical arm (24). The horizontal arm is hingedly suspended in the cap and engages the valve mechanism to actuate the valve mechanism upon pulling the vertical arm towards the container portion. The body portion of the container has a lower portion (40) and an upper portion (41) providing a one-band grip (42). The vertical arm is arranged to be engageable by at least one finger of a hand gripping the one-band grip. The one-hand grip is constricted in its circumference with respect to the lower portion.

19 Claims, 3 Drawing Sheets

U.S. PATENT DOCUMENTS 6,003,738 A * 12/1999 Foster et al. ..... 222/384
D421,391 S * 3/2000 Anderson et al. ..... D9/542
6,168,050 B1 * 1/2001 Battegazzore ..... 222/207
D449,539 S * 10/2001 Lakatosh et al. ..... D9/530
D463,972 S * 10/2002 Perrin et al. ..... D9/685
2007/0062980 A1 * 3/2007 Bates et al. ..... 222/402.13

* cited by examiner

DISPENSING DEVICE FOR DISPENSING A PRODUCT

FIELD OF THE INVENTION

The invention relates to a dispensing device for dispensing a product. The dispensing device being of the type comprising a container containing the product under pressure and a valve mechanism mounted at the top of the container, which valve mechanism is movable with respect to the container for pressurised discharge of the product out of the container.

BACKGROUND OF THE INVENTION

Dispensing devices of the type to which the invention relates are known for long. Such dispensing device can for example have pressurized containers of the aerosol type, in which the container contains the product to be dispensed as well as a pressurising fluid. The dispensed product can for example be paint, oil, such as lubrication oil, insecticide, deodorant, hairspray, wood and furniture polish etc. It is known that also many other types of product are dispensed with such dispensing devices.

In general the valve mechanism is mounted at the top of the container and contains a button to be pushed in with one finger so that product is discharged through a nozzle contained in the button.

U.S. Pat. No. 3,987,842 discloses a modified version of this general type of dispensing device. The valve mechanism is not operated via a button directly placed on the valve mechanism but via a lever carried by a cap mounted on top of the container. This lever contains a horizontal arm and a vertical arm, the latter extending in the axial direction of the container. The horizontal arm of the actuating member comprises a fork, the teeth of which are positioned on opposite sides of the axial pail of the valve mechanism. The free end of the horizontal arm is hingledly suspended so that upon pulling the vertical arm towards the container the horizontal arm tilts downwards to press down the valve mechanism in order to discharge product.

A disadvantage of this type of dispensing device is that the accuracy in aiming at a target is influenced by the stability of the hand holding the device. Not withstanding that such a trigger type operated dispensing device is believed to promise a better aiming accuracy then the general type device in which a button is pressed in axial direction of the container by a finger, the hand holding the container and operating the gripper appears to be susceptible for instability when aiming at the target.

The present invention has as its object providing an improved dispensing device of the type comprising an actuating member having a horizontal arm and a vertical arm, which is easier to handle.

SUMMARY OF THE INVENTION

According to the invention the dispensing device for dispensing a product comprises:

a container containing the product under pressure, the container having a top, bottom and body portion, an axial direction being defined between the bottom and top;

a valve mechanism mounted at the top of the container, the valve mechanism being movable with respect to the container for pressurized discharge of the product out of the container;

a dispensing cap mounted on the top of the container.

The dispensing cap of the dispensing device according to the invention carries: a nozzle debauching outside the cap for spraying the product, the nozzle being connected to the valve mechanism by a conduit; as well as an actuating member having a horizontal arm and a vertical arm, the horizontal and vertical arm being rigidly connected to each other. The terms vertical and horizontal arm are related to the dispensing device considered in upright standing condition. The vertical arm extends in the axial direction of the container with its free end facing downwards. The horizontal arm is hingedly suspended in the cap and engages the valve mechanism to actuate the valve mechanism upon pulling the vertical arm towards the body portion. The body portion can be seen as divided into a lower portion and an upper portion, the upper portion of the body portion comprising a one-hand grip. The "upper portion comprising a one-hand grip" is to be understood as dimensioned so that the dispensing device can be held by one-hand gripping around the one-hand grip provided at the upper portion of the body portion of the container. In order to be able to operate the actuating member with the same hand, the vertical arm is arranged to be engagable by at least one finger of the hand gripping the one-hand grip. According to the invention the one-hand grip is in its circumference constricted with respect to the lower portion. This means that the circumference of the upper portion is smaller than the circumference of the lower portion and that consequently the lower portion has a volume per axial length—of the container—unit which is larger than the volume per axial length unit of the upper portion. By configuring the container body in this manner, the centre of gravity of the dispensing device is—considered with respect to prior art devices having a container of the same volume—shifted downwards towards the bottom of the container without increasing the axial length of container being required. The device is thus easy to handle. Assuming that during dispensing the top of the container is directed upwards—which is for this kind of dispensing devices advisable—this means that the hand holding and actuating the dispensing device can be held more stable. A dispensing device which is easier held stable enables a more accurate aiming of the nozzle at the target.

The holding stability and thus the accuracy of aiming at a target can be further improved when the upper end of the one hand grip widens with respect to the centre of the one-hand grip to provide a supporting surface adapted for resting on the upper part of a hand gripping around the one-hand grip. The widening of the upper and of the one hand grip following, viewed in the axial direction, a continuous curvature, provides this advantage that the dispensing device lies more comfortable in the hand, which contributes in the aiming accuracy. This comfort is improved when the continuous curvature has a radius between 55 and 75 mm, preferably between 60 and 72 mm. The comfort of use is further improved when the lower end of the one-hand grip also widens with respect to the centre of the one-hand grip to provide a supporting surface, in this case adapted for supporting the lower part of a hand gripping around the one-hand grip. Also in this case it is advantageous when this widening of the lower end of the one-hand grip follows, viewed in the axial direction, a continuous curvature. Preferably this continuous curvature at the lower end of the one-hand grip has a radius between 55 and 75 mm, preferably between 60 and 72 mm. The lower end of the one-hand grip and the upper hand of the one-hand grip can thus be shaped mirror symmetrically.

It is according to the invention advantageous when the axial length of the one-hand grip is at least 90 mm, preferably at least 110 mm, such as long as 125 mm or more. An axial length of at least 90 mm ensures that an average sized male hand can be accommodated in the restricted zone of the one-hand grip. An axial length of at least 110 mm ensures that a male hand of average size can easily be accommodated in the restricted zone, allowing that a glove protecting the hand is worn. An axial length of at least 110 mm further ensures that most of the male hands of above average size can be accommodated. An axial length of 125 mm or more ensures that most of the male hands of above average size, also in case a glove is worn, can be accommodated in the restricted zone.

According to the invention it is further advantageous when the circumference of the centre of the one-hand grip is at most 190 mm, preferably at most 180 mm, more preferably at most 170 mm. A circumference of at most 190 mm, corresponding to a circle diameter of about 60-61 mm, provides a one-hand grip, which can be held good by a male hand of above average size, and which can also be held by a male hand of average size. A circumference of at most 180 mm, corresponding to a circle diameter of about 57 mm, provides a one-hand grip which can be held very solidly by a male hand of above average size, and which can be held good by a male hand of average size. A circumference of at most 170 mm, corresponding to circle diameter of about 54-55 mm, provides a solid grip for a male hand of average size.

According to a further embodiment of the invention, the circumference of the lower portion of the body is at least 200 mm, corresponding to a circle diameter of about 63-64 mm, the circumference of the lower portion of the body preferably being at least 205 mm, corresponding to a circle diameter of about 65-66 mm.

According to a further embodiment of the invention, the height of the container is at least 20 cm, such as at least 24 cm. A container with an height of at least 20 cm is capable of containing a minimal economic volume of product. In this respect it is noted that the internal volume of the container is advantageously at least about 650 ml. Such a container can certain contain about 500 ml product, such as paint.

According to a further advantageous embodiment of the invention, the nozzle is fixed with respect to the cap. A nozzle fixed with respect to the cap prevents the nozzle from moving together with the actuating member, which would make aiming of the nozzle at the target less accurate.

According to a further embodiment of the invention, the vertical arm of the actuating member is arranged essentially below the nozzle. Arranging the vertical arm essentially below the nozzle enables accurately aiming the nozzle at the target. A further advantage is that drips of products originating from the nozzle can be collected on the horizontal arm—not only when the device is held upright but also when the device is held in a slanting position—. Drips collected on the horizontal arm can—when the device is held upright—be guided into the cap so that the user is prevented from contacting. In this respect it is of additional advantage when the horizontal arm projects from the cap. In this respect it is to be noted that only a slight projection of about 0.5 mm is sufficient. According to a further advantageous embodiment, which optionally can advantageously be applied with the vertical and/or horizontal arm arranged essentially below the nozzle, the nozzle is arranged submerged in a recess formed in the cap. A submerged arrangement of the nozzle in the cap provides collection means for small drips coming out of the nozzle at the start or at end of a spraying action. The submerged recess will provide for retainment of the small drips in the recess so that the hand of the user is prevented from contacting the drips. Advantageously the recess containing the submerged nozzle will be in liquid communication with the hollow internal of the cap, so that drips of product, such as paint, can flow into the cap where they do not harm. The hands of the user are thus being protected against becoming dirty.

It will be clear to the skilled person that a nozzle submerged in a recess formed in the cap, the recess preferably being in fluid communication with the internal of the cap, can advantageously be used also independent from the type of actuating member and most certainly independent from the one-hand grip. This submerged nozzle thus presents an independent invention.

In order to prevent inadvertently spraying, the container is, at its top, provided with a stop and the actuating member is around the axial direction rotatable with respect to the stop between a locked position in which the stop lies under the horizontal arm of the actuating member to prevent movement of the actuating member and an unlocked position in which the stop lies beside the actuating member to allow movement of the actuating member. By rotating the stop and the actuating member with respect to each other, one can prevent the actuating member from any movement as well as allow actuating of the actuating member.

The invention is explained in great detail below with reference to the schematic drawings of an illustrative, presently preferred embodiment.

DETAILED DESCRIPTION

Figure 1:
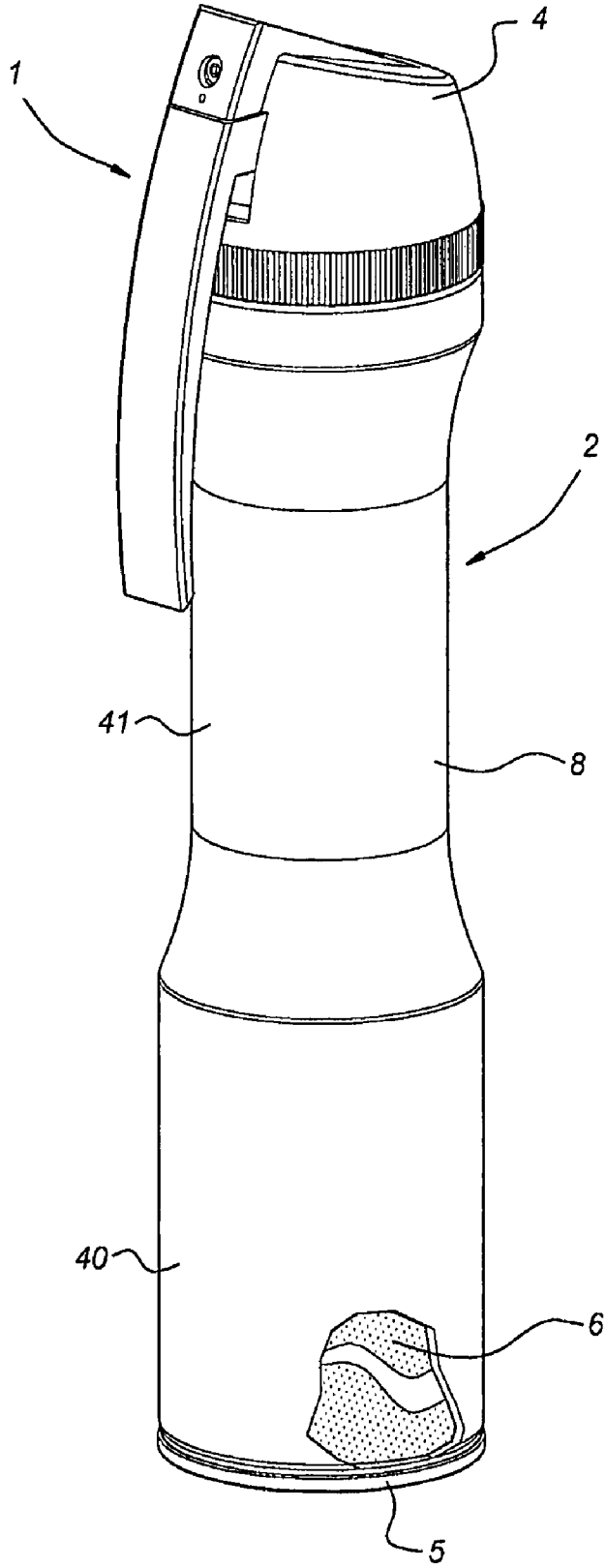
FIG. 1 shows a perspective, symmetric view of a dispensing device according to the invention.

The dispensing device 1 according to the present invention comprises a container 2, a conventional valve mechanism 3 and a dispensing cap 4.

The container 2 has a bottom 5, a top 7 and body portion 8. The bottom 5, top 7 and body portion 8 are, in a manner conventional, secured to each other to define an airtight inner volume 9. The inner volume 9 contains product 6 to be dispensed.

A conventional valve mechanism 3 is provided on the top 7 of the container 2. Briefly described, this conventional valve mechanism 3 comprises a fixed part 10 having a through going bore 11. The fixed part 10 is fixed in an airtight manner to the top 7 of the container. The bore 11 has an upper part of larger diameter. In this upper part there is provided a pin 12 with a blind bore 14. The pin 12 being movable up and down, according to arrow 13. Below the pin 12 there is provided a spring 17 urging the pin 12 in the upward direction. The blind bore 14 has at its lower side a side bore 77, debouching in the side of the pen 12. In the upper position, shown in FIG. 2, the side bore 77 is at the outside of the pin 12 closed by sealing 18. Upon pressing the pin 12 sufficiently far downwards, the side bore 77 arrives in the upper part of the bore, which is of larger diameter than the pin 12. The product under pressure is than allowed to discharge via bore 11, side bore 17, and blind bore 12.

The top of the conventional valve mechanism 3 is provided with a fitting tube 19, carrying a flexible tubing 20 connecting the internal bore 22 of the fitting tube 19 with the nozzle 21. Thus subsequent on being discharged from the blind bore 14, the product under pressure goes via the bore 12 and flexible tubing 20 to the nozzle 21 to be discharged by spraying.

In order to actuate the valve mechanism 3 the cap 4 carries an actuating member 23. This actuating member 23 comprises a vertical arm 24 and a horizontal arm 25, the vertical arm 24 and horizontal arm 25 being essentially rigidly connected to each other. The free end of the horizontal arm 25 is provided with a bending hinge 26, which mounts this free end of the horizontal arm 25 on a hinging manner to the cap 4. It will be clear that this hinge 26 can also be made differently, for example as a line-hinge. Upon pushing the vertical arm 24 according to arrow 27 towards the body part 8 of the container 2, the forked horizontal arm 25 presses the pin 12 via the abutment surface 28 downwards.

Figure 2:
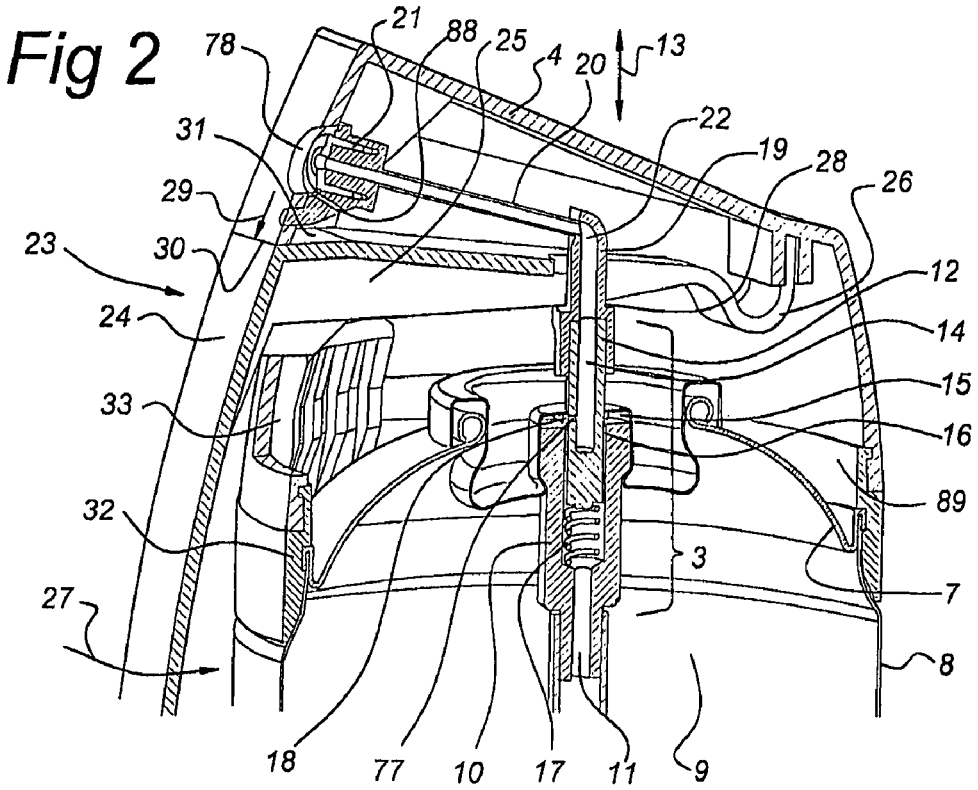
FIG. 2 shows a symmetric view in cross section of the top part of the device shown in FIG. 1.
Figure 3:
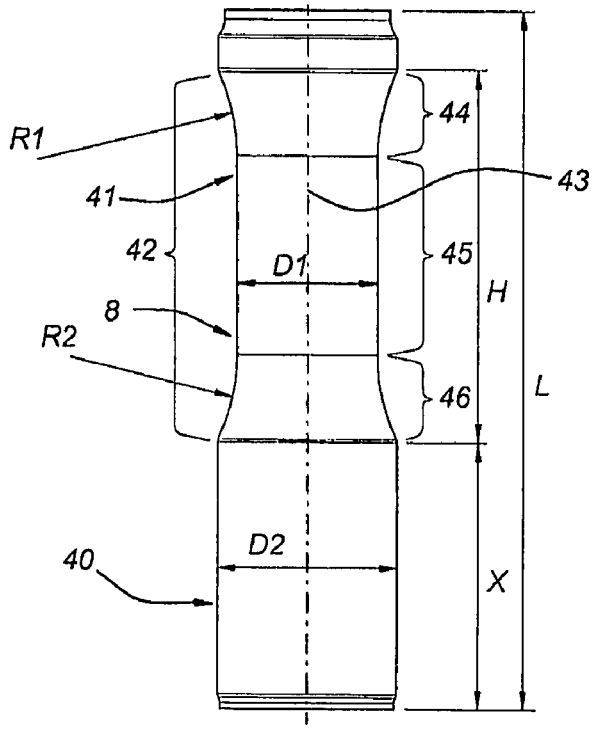
FIG. 3 shows a symmetric view on the body portion of the contain of the dispensing device of FIG. 1.

As can be seen in FIG. 2, the nozzle 21 is arranged submerged in a recess 78 formed in the cap 4. The recess 78 thus provides a collecting means for retaining small drips coming out of the nozzle 21. In case larger drips come out of the nozzle 21 or in case the recess 78 contains too much drips or possibly solidified product, the drips could flow, as indicated by arrow 29, downwards. In case there is a fluid communication 88 between the recess 78 containing the nozzle 21 and the internal 89 of the cap, flowing of drips according to arrow 29 will be prevented. The arrow 29 is thus to be considered as elucidating, what could happen in a worse case. When the vertical part 24 of the actuating member 23 is pressed towards the container 2, there will be at the location indicated by reference number 30 a small gap, so that those drips can fall on the top surface 31 of the horizontal arm to be guided into the cap 4 so that those drips are kept away from making the hand of the user ditty.

In order to be able to lock the actuating member 23 in a condition so that the pin 12 can not be pressed downwards, the cap 4 is mounted on the container 2 through an intermediate ring 32. The ring 32 can be nonmovable mounted with respect to the container 2. The ring 32 carries the cap 4 in a manner that the cap 4 and the ring 32 can rotate with respect to each other. The ring 32 carries a locking ridge 33. The locking ridge 33 is dimensioned such that when it is below the horizontal arm 25 of the actuating member 23, the horizontal arm 25 is restrained from any movement. By rotating the cap 4 and ring 32 with respect to each other, the locking ridge 33 can be moved to a position below the horizontal arm 25 or a position beside the horizontal arm 25.

The body part 8 of the container has a lower portion 40 and upper portion 41. The upper portion 41 comprises a one-hand grip 42. The circumference of the one-hand grip 42 is smaller than the circumference of the lower part 40. This circumference of the one-hand grip 42, at least in its central part, is dimensioned such that it can be easily gripped by one-hand gripping around it. Although—considered in cross section transverse to the longitudinal axis 43—the shape of the container can be elliptical or oval, it is preferably circular. The diameter D1 of this circular cross section is according to this embodiment 52 mm in the central region of the one-hand grip. The upper end 44 of the one-hand grip 42 widens with a curvature R1 of about 68 mm, which curvature R1 preferably continuously connects to the central part 45 of the one-hand grip 42. The lower end 46 of the one-hand grip 42 is mirror symmetrical with the upper end 44, consequently the radius R2 is identical to the radius R1. The diameter D2 of the lower part 40 of the body part of the container is in this embodiment 66 mm. The height H of the one-hand grip 42 is in this embodiment 130 mm. The length L of the body part 8 of the container is in this embodiment about 245 mm. The body part 98 of the container 2 as just described, enables a container 2 with an internal volume of about 650 ml which can contain about 500 ml paint as product. In case this internal volume is to be increased the diameter D2 can be increased and/or the length X of the lower part 40 of the container can be increased. In both cases, when compared to the prior art, a relatively short—in axial direction—container having a relatively large internal volume is obtained.

Figure 4:
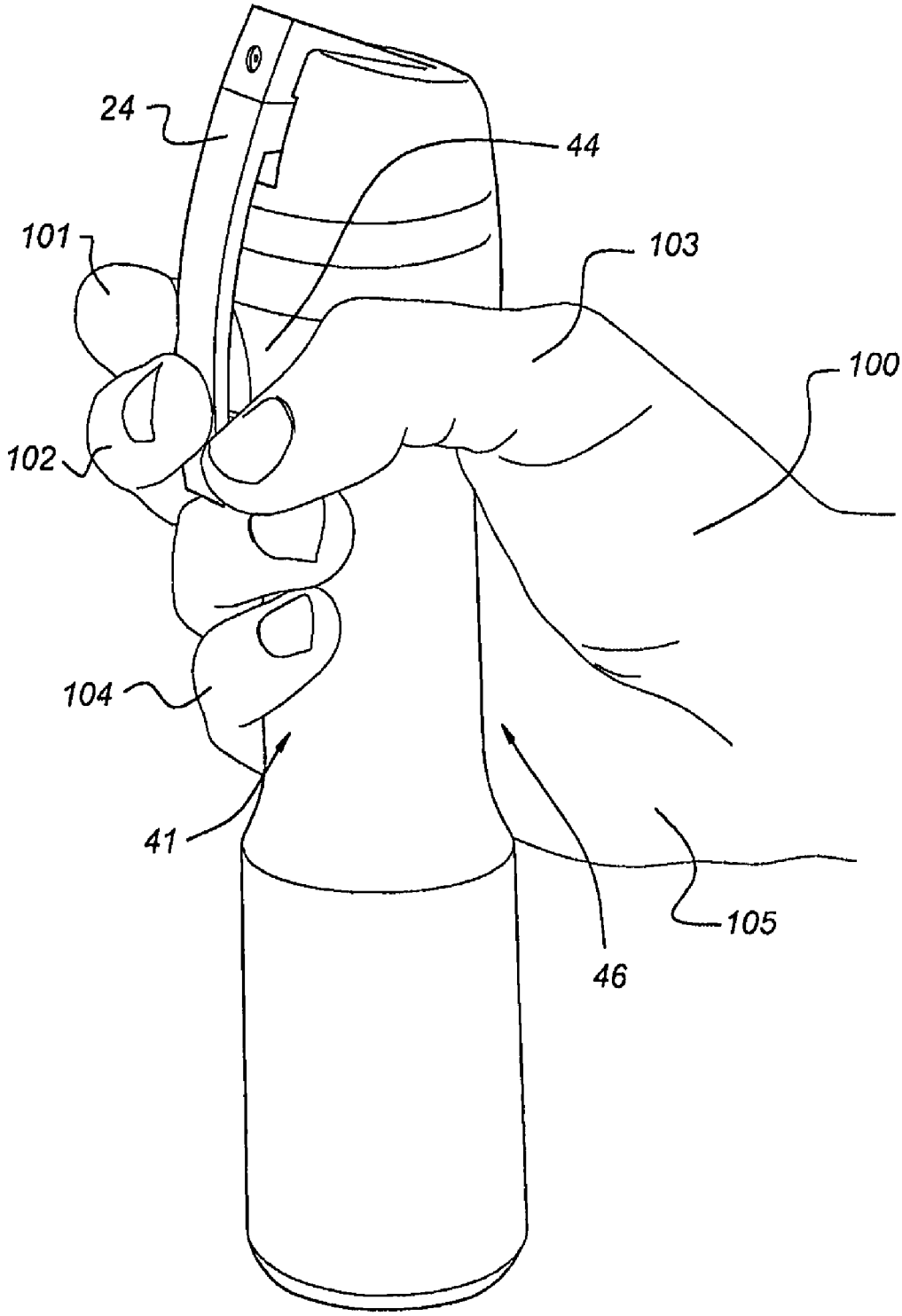
FIG. 4 shows in perspective the device of FIGS. 1-3 held by a hand.

As shown schematically in FIG. 4, the user can grip 100 with one hand around the one-hand grip part 41 in a manner so that his indexing finger 101 and/or middle finger 102 are free to operate the vertical arm 24 of the actuating member 23. The curved, widening upper part 44 of the one-hand grip 42 provides additional stability as the surface of this upper part 44 finds rest on the inner/upper side of the hand 100 defined by the indexing finger 101, the thumb 103 and the region in between the indexing finger 101 and thumb 103. About the same applies for the lower part 46 of the one-hand grip, which provides support for the lower part of the hand, especially the inside/lower side of the little finger 104 and palm 105 of the hand 100.

The dispensing device according to this invention is suitable for dispensing products like paint, oil, insecticide, deodorant, hairspray, wood and furniture polish etc. It will be clear that those products are given as an example and that also many other types of product can be dispensed with a dispensing device according to the invention.

The invention claimed is:

1. A dispensing device for dispensing a product comprising:

a. a container containing the product under pressure, the container having a top, bottom and body portions, with a central longitudinal axis extending, between the bottom and top portions;

b. a valve mechanism mounted at the top of the container, the valve mechanism being movable with respect to the container for pressurized discharge of the product out of the container; and c. a dispensing cap mounted on the top of the container, in which the dispensing cap carries:

(i) a nozzle debouching outside the cap for spraying the product, the nozzle being connected to the valve mechanism by a conduit; and (ii) an actuating member having a horizontal arm and a vertical arm, in which the vertical arm and horizontal arm are rigidly connected to each other, in which the vertical arm extends in the axial direction of the container with its free end facing downward, in which the horizontal arm is hingedly suspended in the cap and engages the valve mechanism to actuate the valve mechanism upon pulling the vertical arm towards the container body portion, in which the body portion has a lower portion and an upper portion providing a one-hand grip, and in which the vertical arm is arranged to be engageable by at least one finger of a hand when gripping the one-hand grip, wherein the one-hand grip has a smaller cross-section with respect to the lower portion wherein the container is at its top provided with a stop that is rotatable with respect to said actuating member about said central longitudinal axis between a locked position in which the stop lies under the horizontal arm of the actuating member to prevent downward movement of the horizontal arm of the actuating member, and an unlocked position in which the stop lies horizontally displaced from the actuating member to allow downward movement of the horizontal arm of the actuating member.

2. The device according to claim 1, wherein the upper end of the one-hand grip widens with respect to the centre of the one-hand grip to provide a supporting surface adapted for resting on the upper part of a hand gripping the one-hand grip.

3. The device according to claim 2, wherein the widening of the upper end of the one-hand grip follows, viewed the axial direction, a continuous curvature.

4. The device according to claim 3, wherein the continuous curvature has a radius between 55 and 75 mm.

5. The device according to claim 1, wherein the lower end of the one hand grip and the upper end of the one hand grip are shaped mirror symmetrically.

6. The device according to claim 1, wherein the axial length of the one-hand grip is at least 90 mm.

7. The device according to claim 1, wherein the circumference of the centre of the one-hand grip is at most 190 mm.

8. The device according to claim 1, wherein the circumference of the lower portion of the body is at least 200 mm.

9. The device according to claim 1, wherein the height of the container is at least 15 cm.

10. The device according to claim 1, wherein the internal volume of the container is at least about 650 ml.

11. The device according to claim 1, wherein the nozzle is fixed with respect to the cap.

12. The device according to claim 1, wherein the vertical arm is arranged essentially below the nozzle.

13. The device according to claim 1, wherein the nozzle is arranged submerged in a recess formed in the cap.

14. The device according to claim 12 wherein said horizontal arm projects from said cap.

15. The device according to claim 1, wherein the dispensing cap is mounted on the container through an intermediate ring, the ring carrying the cap in a manner that the cap and the ring are rotatable with respect to each other, the ring carrying a locking ridge dimensioned such that when the locking ridge is below the horizontal arm of the actuating member, the horizontal arm is restrained from any movement, and the locking ridge being movable to a position below the horizontal arm or a position beside the horizontal arm.

16. The device according to claim 1, wherein the vertical arm is arranged essentially below the nozzle and the nozzle is arranged submerged in a recess formed in the cap.

17. The device according to claim 1, comprising a fluid communication between the recess and the internal of the cap.

18. A dispensing device for dispensing a product comprising:

a. a container containing the product under pressure, the container having a top, bottom and body portions, with a central longitudinal axis extending between said bottom and top portions;

b. a valve mechanism mounted at the top of the container, the valve mechanism being movable with respect to the container for pressurized discharge of the product out of the container; and c. a dispensing cap mounted on the top of the container, in which the dispensing cap carries:

(i) a nozzle debouching outside the cap for spraying the product, the nozzle being connected to the valve mechanism by a conduit;

(ii) an actuating member having a horizontal arm and a downward arm formed as a single element, in which the downward arm extends in the downward direction of the container, in which the horizontal arm is hingedly coupled to the cap and engages the valve mechanism to actuate the valve mechanism upon pulling the downward arm towards said body portion of said container, in which said body portion has a lower portion and extending upward therefrom an upper portion which has smaller cross-section than said lower portion and provides a one-hand grip, and in which the vertical arm is arranged to be engageable by at least one finger of a hand when gripping said one-hand grip of said upper portion, and wherein said container is at its top provided with a stop, and wherein said stop is rotatable with respect to said actuating member about said central longitudinal axis between a locked position in which the stop lies under the horizontal arm of the actuating member to prevent downward movement of the horizontal arm of the actuating member, and an unlocked position in which the stop lies horizontally displaced from the actuating member to allow downward movement of the horizontal arm of the actuating member.

19. A dispensing device for dispensing a product comprising:

a. a container containing the product under pressure, the container having a top, bottom and body portions, with a central longitudinal axis extending between said bottom and top portions;

b. a valve mechanism mounted at the top of the container, the valve mechanism being movable with respect to the container for pressurized discharge of the product out of the container; and c. a dispensing cap mounted on the top of the container, in which the dispensing cap carries:

(i) a nozzle debouching outside the cap for spraying the product, the nozzle being connected to the valve mechanism by a conduit;

(ii) an actuating member having a horizontal arm and a downward arm formed as a single element, in which the downward arm extends in the downward direction of the container, in which the horizontal arm is hingedly coupled to the cap and engages the valve mechanism to actuate the valve mechanism upon pulling the downward arm towards said body portion of said container, in which said body portion has a lower portion and extending upward therefrom an upper portion which provides a one-hand grip, and in which the downward arm is arranged to be engageable by at least one finger of a hand when gripping said one-hand grip of said upper portion, and wherein said container is at its top provided with a stop, and wherein said stop is rotatable with respect to said actuating member about said central longitudinal axis between a locked position in which the stop lies under the horizontal arm of the actuating member to prevent downward movement of the horizontal arm of the actuating member, and an unlocked position in which the stop lies horizontally displaced from the actuating member to allow downward movement of the horizontal arm of the actuating member.

* * * * *